United States Patent [19]

Ciriaci et al.

[11] Patent Number: 4,628,981

[45] Date of Patent: Dec. 16, 1986

[54] VERTICAL BLIND ASSEMBLY

[75] Inventors: Piergiorgio Ciriaci, Hollywood; Giovanni Acocella, Miami, both of Fla.

[73] Assignee: Micro Molds Corporation, Miami, Fla.

[21] Appl. No.: 719,608

[22] Filed: Apr. 8, 1985

[51] Int. Cl.[4] ..... E06B 9/36

[52] U.S. Cl. ..... 160/176 R; 160/168 R; 160/166 A

[58] Field of Search ..... 160/166 A, 168 R, 176 R, 160/174

[56] References Cited

U.S. PATENT DOCUMENTS

| | | | |
|---|---|---|---|
| 2,625,219 | 1/1953 | Peck | 160/168 |
| 2,754,902 | 7/1956 | Attkisson | 160/166 A |
| 2,759,534 | 8/1956 | Harju | 160/168 |
| 3,134,428 | 5/1964 | Kehner et al. | 160/172 |
| 3,500,896 | 3/1970 | Endou | 160/168 R |
| 3,996,988 | 12/1976 | DeWit | 160/168 R |
| 4,047,554 | 9/1977 | Bullat | 160/168 R |
| 4,102,381 | 7/1978 | Bratschi | 160/168 R |
| 4,103,727 | 8/1978 | Spohr | 160/168 R |
| 4,122,884 | 10/1978 | Salzmann | 160/168 R |
| 4,214,622 | 7/1980 | Debs | 160/168 A |
| 4,257,470 | 3/1981 | Woodle | 160/172 |
| 4,262,728 | 4/1981 | Debs | 160/168 R |
| 4,267,875 | 5/1981 | KoKs | 160/168 R |
| 4,291,738 | 9/1981 | Grenga | 160/176 R |
| 4,293,021 | 10/1981 | Arena | 160/166 A |
| 4,306,608 | 12/1981 | Frentzel et al. | 160/176 R |
| 4,332,288 | 6/1982 | Frentzel et al. | 160/176 R |
| 4,335,775 | 6/1982 | Frentzel et al. | 160/177 |
| 4,361,179 | 11/1982 | Benthin | 160/176 R |
| 4,386,644 | 6/1983 | Debs | 160/174 |

FOREIGN PATENT DOCUMENTS

| | | | |
|---|---|---|---|
| 8200515 | 2/1982 | Netherlands | 160/166 A |

*Primary Examiner*—Ramon S. Britts
*Assistant Examiner*—Cherney S. Lieberman
*Attorney, Agent, or Firm*—John Cyril Malloy

[57] ABSTRACT

A vertical blind assembly of the type capable of positioning a plurality of vertical blinds in depending relation along the length of a head casing and selectively and concurrently rotate each of said vertical blinds in a predetermined angular orientation about its own longitudinal axis wherein a holder for each vertical blind is removably supported by a carrier frame and further wherein a first gear and a second gear are removably mounted on the carrier frame so as to cause the aforementioned rotation and angular orientation of the vertical blinds. The assembly further comprises a plurality of connecting links removably attached to one another in an interlocking fashion so as to interconnect the various carrier frames along the length of the casing head. A first positioning pull-cord or like assembly is operable to extend the plurality of blinds along the length of the head casing or retract such plurality at one end thereof. The various components of the carrier structure including the holder is removably attached to the carrier frame to facilitate repair, assembly, disassembly and maintenance.

16 Claims, 18 Drawing Figures

VERTICAL BLIND ASSEMBLY

BACKGROUND OF THE INVENTION

1. Field of the Invention

This invention relates to a vertical blind assembly wherein a plurality of vertical blinds may be selectively positioned to extend along the entire length of a head casing itself being disposed in overhanging relation to an opening such as a doorway, window, etc. In addition, each of the vertical blinds may be concurrently rotated or tilted about their respective longitudinal axes so as to provide a common angular orientation of the vertical blinds.

2. Description of the Prior Art

Vertical blind assemblies or structures of the type incorporating a plurality of vertically oriented and depending blinds capable of traversing the length of a track mounted in a suspended head casing are well known in the prior art and commercially available to the public in various forms and designs. Typically, such assembly provides for the traversing movement of the plurality of depending blinds in the aforementioned fashion and also allows the angular rotation or tilting of the blinds collectively into a common angular orientation about the respective longitudinal axis of the blinds. This angular orientation controls or regulates the amount of light or viewing through the individual blinds.

Vertical blind assemblies of the type mentioned above generally include a holder for each of the blinds removably secured to an upper end thereof. Each holder is pivotally or rotatably mounted on a carrier structure. The individual carrier structures are extendable along the length of the head casing or alternately retracted into a closely adjacent positioning. Such positioning depends on whether it is preferred to extend the vertical blinds along the entire length of the head casing or collect the blinds at one end thereof so as to allow complete passage or access through the opening which the vertical blind assembly is intended to overhang and possibly cover. A positioning structure or assembly is associated in driving interconnection with each of the carrier structures supporting the individual holders and attached blinds wherein such positioning means is structured to provide the aforementioned travel and/or angular or pivotal movement of the blinds.

Numerous United States patents are in existence which are specifically directed to the prior art of vertical blind assemblies. While the structures disclosed in such patents are considered to be operable for their intended and designed purpose, frequently numerous prior art structures are considered to be rather complex and therefore add to the initial expense of the vertical blind assembly or the cost of maintenance and/or repair of such structures.

While complexity is a factor in considering the structural components and operative features of blind assemblies of this type, it should also be kept in mind that various structural components utilized in such structures are frequently required to be replaced and/or repaired in order to keep the assembly in proper working order. Therefore, there is still a recognized need in the prior art relating to blind assemblies for a vertical blind structure specifically designed to be long-lasting and durable and incorporate a design configuration which allows easy replacement and/or repair of the various components of such a structure without total disassembly. Such a preferred vertical blind assembly therefore should be specifically structured to include various components removably interconnected to one another in a manner which would facilitate replacement of any single component and further facilitate the initial assembly and/or construction of the various components in a systematic manner.

SUMMARY OF THE INVENTION

This invention is directed towards a vertical blind assembly of the type incorporating a plurality of vertically oriented blinds supported in depending relation from a head casing. The head casing is secured to extend along a given length above an area such as a passageway, window, doorway, etc. Generally, dependent upon the particular structural application, the plurality of blinds are interconnected to a holder and a carrier means, the latter movably supported within the head casing by a track structure such that the plurality of blinds are supported to traverse the length of the head casing between a closed position, relative to the subject passage or doorway, and an open position relative thereto. The closed position is defined by the plurality of blinds disposed in spaced apart relation to one another and extending along the length, or a portion thereof, of the head casing. The open position is defined by the plurality of blinds disposed in a collected contracted position, preferably at one end of the head casing such that the covered passage or doorway is clear of such blinds.

Each of the blinds is suspended in a manner which selectively allows for the pivotal or rotational orientation of each blind about its own longitudinal axis. Therefore, the vertical blinds may be angularly oriented collectively so as to allow light to pass therethrough or viewing therethrough or alternately, to obstruct light or viewing therethrough.

In order to efficiently accomplish the above operative features of the present invention, each of the vertical blinds is removably secured at its upper longitudinal end to a holder such that the blind depends therefrom. The holder is movably and removably mounted on a carrier means and more specifically is snap-fitted for ease of removal and replacement to a carrier frame thereof. Such snap-fit connection, in addition to allowing the efficient and quick assembly and disassembly of the holder, allows rotation of the holder about its own longitudinal axis. Similarly, and as set forth above, the blind is allowed to be pivoted or rotated about its own longitudinal axis due to its securement to the holder.

Each carrier means associated with each vertical blind includes a first gear element, preferably a worm gear, which is connected to rotate with a positioning rod. The positioning rod extends substantially the entire length of the head casing in interconnected and driving relation with each of the respective first gear elements of each carrier means. The first gear element is removably and preferably snap-fitted into operative position on the carrier frame for ease of assembly and disassembly generally similar to that of the holder as set forth above.

A second gear element is secured to the holder so as to at least partially rotate therewith. This second gear element, which may be a spur gear, is further disposed in operative, mating and driven engagement by the first gear element. Accordingly, it is readily seen that rotation of the positioning rod causes direct rotation of the first gear element and in turn causes rotation of the second gear element due to the mating engagement with the first gear element. The frictional engagement of the second gear element to the holder in turn causes the rotational or pivotal movement of the holder about its longitudinal axis and similarly the attached vertical blind about its respective longitudinal axis. In that each of the first gear elements are connected to the positioning rod in spaced apart relation to one another, rotation of such positioning rod causes collective rotation or tilting of each of the vertical blinds into the preferred angular orientation relative to the respective longitudinal axis of each vertical blind.

An important feature of the carrier means includes a stop member having one portion rigidly or fixedly attached to the carrier frame and the other mounted on the holder. Accordingly, rotation of the holder causes interruptive and stopping engagement between the two fixed and movable portions respectively of the stop structure thereby limiting the pivotal or rotational movement of the holder and therefore the attached vertical blind through an arc of approximately 180°.

In addition to the above, the subject blind assembly includes connecting means for interconnecting each of the carrier frames to one another. This structure includes a plurality of connecting links pivotally attached to one another and to similar connecting links associated with adjacently positioned carrier frames. The provision of this connecting means causes the successive displacement of each carrier frame and accordingly the holder and blind structures attached thereto upon forced positioning of the endmost carrier frame along the length of the head casing since each of the carrier frames are successively interconnected to one another.

It is readily seen therefore that the vertical blind assembly of the present invention comprises a plurality of components which are quickly assembled and disassembled from one another thereby facilitating both ease of assembly and quick and ready replacement of any of the components without necessitating the disassembly of the entire vertical blind assembly.

The invention accordingly comprises the features of construction, combination of elements, and arrangement of parts which will be exemplified in the the construction hereinafter set forth, and the scope of the invention will be indicated in the claims.

BRIEF DESCRIPTION OF THE DRAWINGS

For a fuller understanding of the nature of the present invention reference is had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
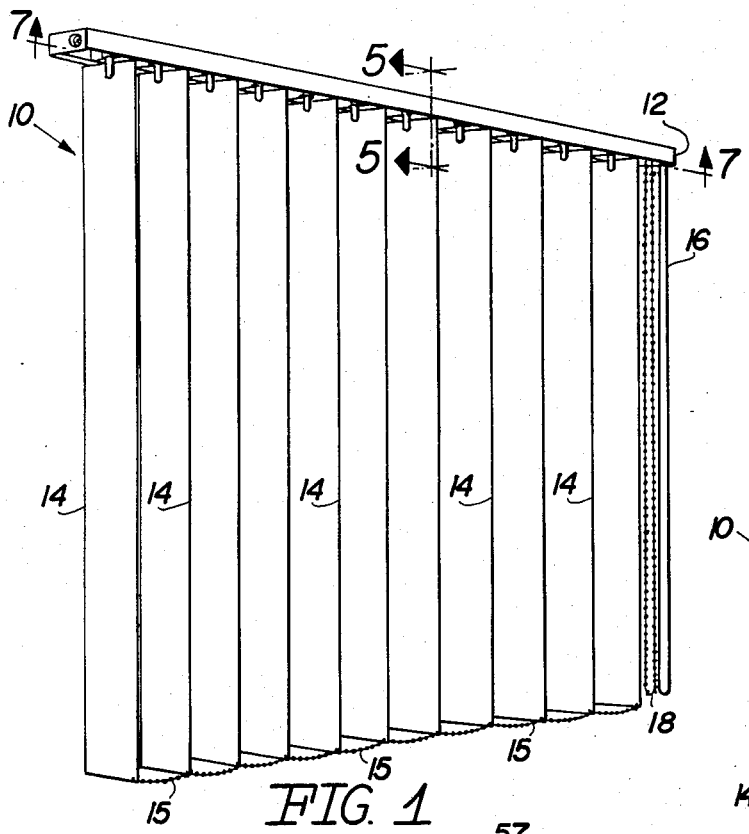
FIG. 1 is an isometric view of a vertical blind assembly of the present invention.

As shown in FIG. 1, the present invention is directed towards a vertical blind assembly generaly indicated as 10 and includes a head casing 12 having an elongated configuration and extending along the length in substantially overhanging relation to a pre-selected area, passageway, doorway, window, etc. The vertical blind assembly 10 therefore serves to selectively obstruct or permit vision or light to pass through the doorway, window, etc. depending upon the angular orientation or attitude of the individual vertically depending blinds 14. As is known in the art, a first positioning means which may be partially defined by a continuous pull-cord assembly 16 is structured for interconnection to each of the blinds 14 to cause their traversal of the length of the head casing 12 when properly manipulated. Similarly, a second positioning means at least partially defined by a beaded pull-chain 18 is interconnected to the individual blinds 14 so as to cause their rotation or pivotal movement about their own longitudinal axis. Accordingly, when so manipulated, the beaded pull-chain 18 serves to control the angular orientation of the blinds 14 collectively in order to permit or obstruct light passage or viewing therethrough.

Figure 2:
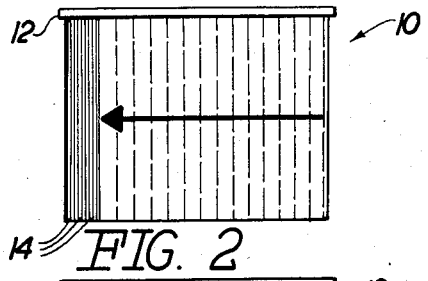
FIG. 2 is a schematic view showing one assembly or orientation of the structure of FIG. 1.
Figure 3:
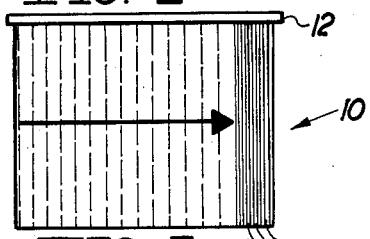
FIG. 3 is a schematic view showing another assembly different than that of FIG. 2 of the orientation of the vertical blind of the embodiment of FIG. 1.
Figure 4:
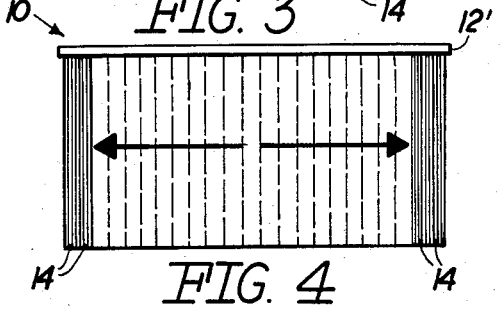
FIG. 4 is yet another orientation of the vertical blind assembly differing from FIGS. 2 and 3.

With respect to FIGS. 2, 3 and 4, the vertical blind assembly 10 of the present invention may be structured such that the plurality of blinds 14 may be collected at one or the other end (FIGS. 2 and 3). In such position the blinds are arranged in immediately adjacent and substantially compacted or retracted position defining an open position of the blind assembly. Passage through a given doorway, passageway, etc. over which the head casing 12 is suspended is thereby possible. Alternately, the structure of the present invention incorporates an arrangement (FIG. 4) wherein the plurality of vertical blinds may be simultaneously collected at opposite ends of the head casing 12' in accordance with the directional arrows so as to open or free the passageway over which the head casing 12' extends. The broken lines in FIGS. 2, 3 and 4 represent the individual blinds 14 collectively positioned in a "closed" position of the blind assembly 10 such that the doorway, window, etc. is covered to prevent clear passage therethrough. In order to facilitate operation of the subject blind assembly 10, the lower ends thereof may be interconnected by appropriately structured cordage 15 which may take a variety of structural configurations and designs.

With primary reference to FIGS. 5 and 8 through 11, each of the blinds 14 is removably supported in depending relation by a holder 20 having a bifurcated distal end portion 22 designed to removably support the upper end 17 of each blind 14. An angularly oriented and outwardly extending hook member 23 is fixedly attached between the bifurcated portions of the distal end 22 of the holder 20 so as to engage and extend between a mounting aperture 24 integrally formed in the upper end 17 of each blind 14. Slight spreading or separation of the bifurcated portions of end 22 facilitates easy mounting and removal of the end 17 from the holder 20 as should be apparent. The holder 20 is rotatably mounted to a carrier means generally indicated as 26 and more specifically to a carrier frame 28. Separate carrier frames 28 are associated in supporting relation to each of the individual holders 20 and blinds 14. The carrier frame 28 includes a first open ended recess 30 and a second open ended recess 32 both of which are disposed in substantially transverse, adjacent and communicating relation to one another. The first recess 30 is specifically structured to have a first gear element 34 mounted therein. This gear element is preferably in the form of a worm gear and includes a centrally disposed channel 35 and integrally formed outwardly extending elongated key element 36 formed in channel 35 to extend along the length thereof. Relative dimensions between the interior surface of the first recess and the exterior surface of the worm gear 34 is such as to allow free rotation of the worm gear 34 about its own longitudinal axis within the recess 30. Further, the positioning and dimension of the open end 37 is such as to allow removable insertion of the gear element 34 into the interior of the recess 30 in what may be considered a "snap-fit" attachment. Similarly, the second recess 32 has an open ended construction as at 39 which allows a similar "snap-fit" removable connection or mounting of the holder 20 therein. This is possible due to the cooperative dimensioning of the annular exterior surface as at 38 of holder 20. Similarly, the holder 20 is allowed to rotate within the recess 32 due to the cooperative dimensioning, as set forth above, of the recess 32 and the annular exterior surface 38 of holder 20.

Figure 5:
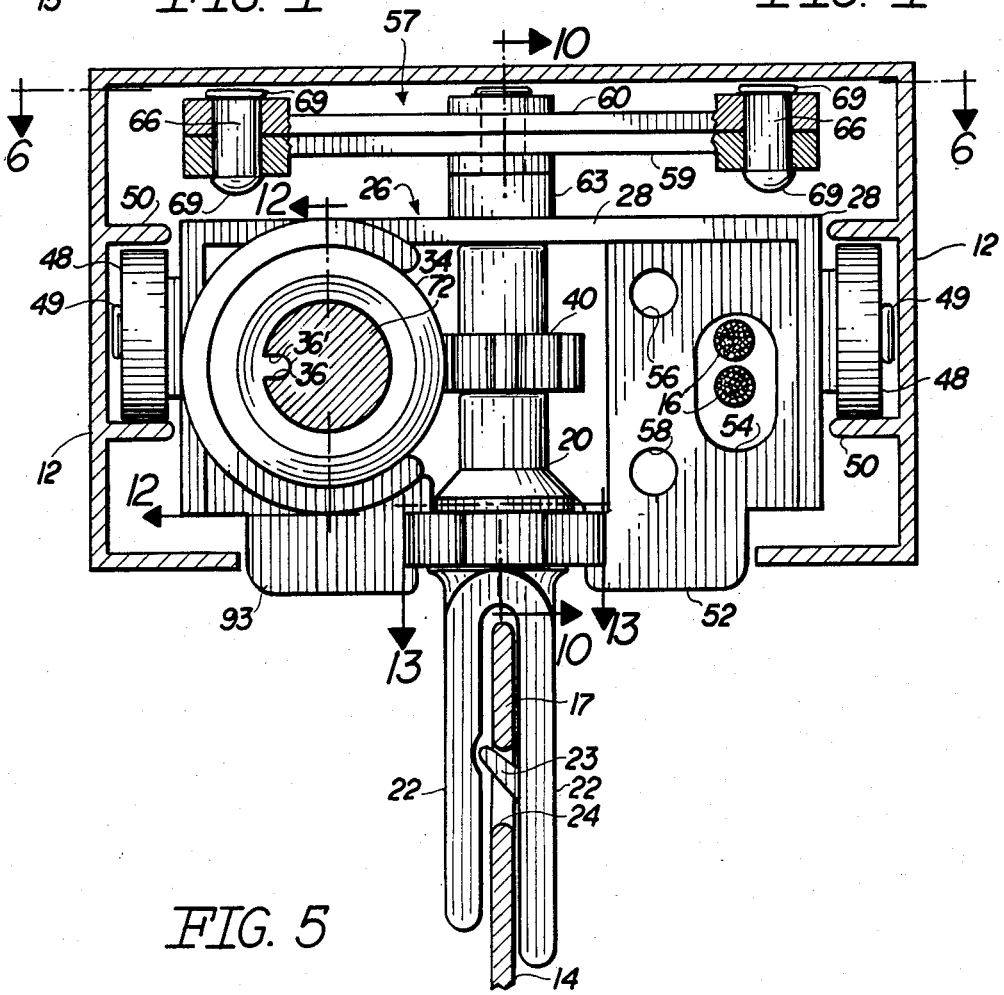
FIG. 5 is a partial sectional view showing structural details of a head casing and carrier structure associated with a vertical blind and holder therefor.
Figure 6:
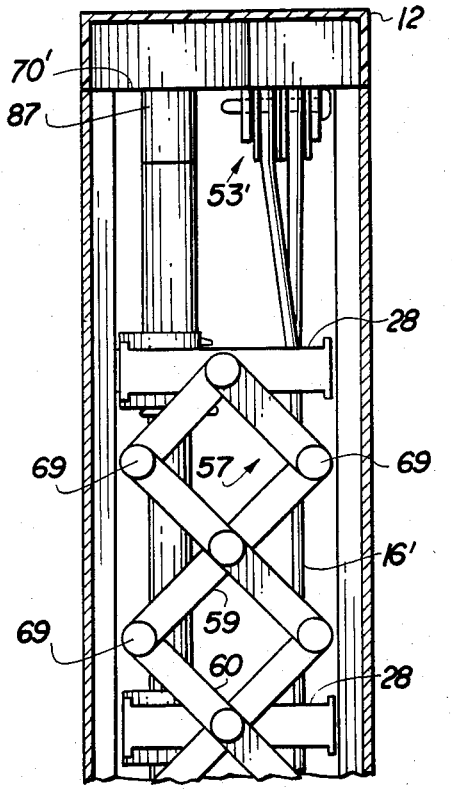
FIG. 6 is a sectional view along line 6—6 of FIG. 5 showing details of a connecting structure for interconnecting each of the various carrier structures to one another.
Figure 6:
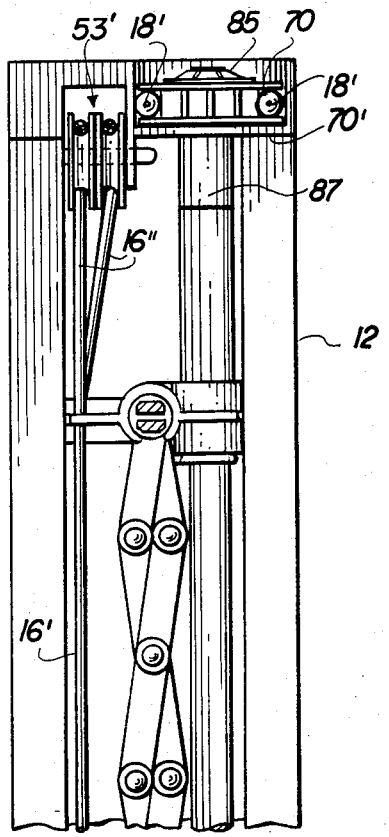
Figure 6:
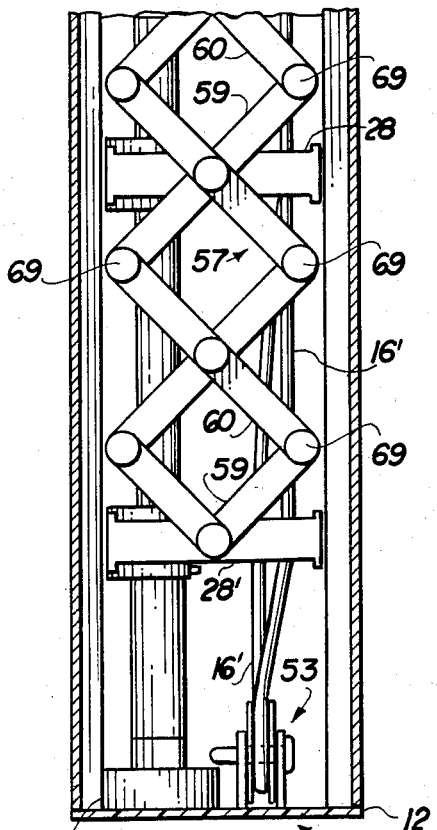
Figure 10:
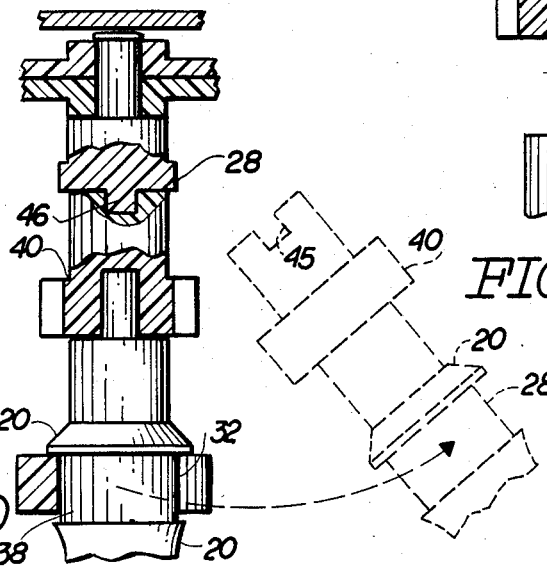
FIG. 10 is a sectional view in partial cutaway along line 10—10 of FIG. 5 wherein removal of structural components therefrom is represented in broken lines.
Figure 11:
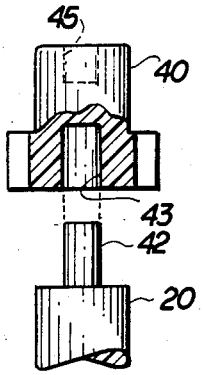
FIG. 11 is a detailed view in partial sectional and breakaway form of the components of FIG. 10.
Figure 12:
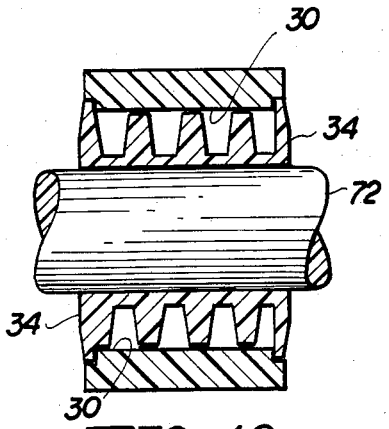
FIG. 12 is a sectional view along line 12—12 of FIG. 5.

A second gear element 40 is removably secured in aligned, substantially coaxial relation to the holder 20 as best seen in FIGS. 5, 10 and 11. Removable connection between second gear element 40 and holder 20 (FIG. 11) is accomplished through frictional engagement between the exterior surface of coaxial finger 42 and the interior surface of receiving channel 43. Such frictional engagement is sufficient to allow rotation of the gear element 40 with the holder 20 at least until a predetermined force or pressure differential is exerted on such frictional connection. More specifically, and with reference to FIG. 5, the first and second gears 34 and 40 are disposed in mating engagement with one another. Accordingly, rotation of the worm gear 34 in turn causes rotation of the second or spur gear 40 which in turn causes rotation of the holder 20 and selected angular orientation of the vertically depending blind 14. However, when rotation of the holder is prevented either due to obstruction of the blind member 14 or interaction between stop portions of the carrier means 26 and continued rotation of the second gear element 40 occurs, relative rotation will occur between the second gear element 40 and the holder 20. This will therefore allow the second gear element 40 to serve as a clutch since the pressure or force differential exerted between the gear element 40 and the holder 20 is sufficient to allow relative rotational movement between the exterior surface of the connecting finger 42 and the receiving channel 43 (see FIG. 11). The opposite end of gear element 40 includes an additional receiving channel 45 structured for receipt of a knob 46 therein. This knob 46 is integrally or otherwise attached in depending relation to the interior surface of the upper peripheral portion of the frame 28. Again with reference to FIG. 10, it is readily seen that the holder as well as the removably secured second gear element 40 can be easily removed from its upright movably supported connection within the second recess 32 as best seen in broken lines in FIG. 10.

Figure 8:
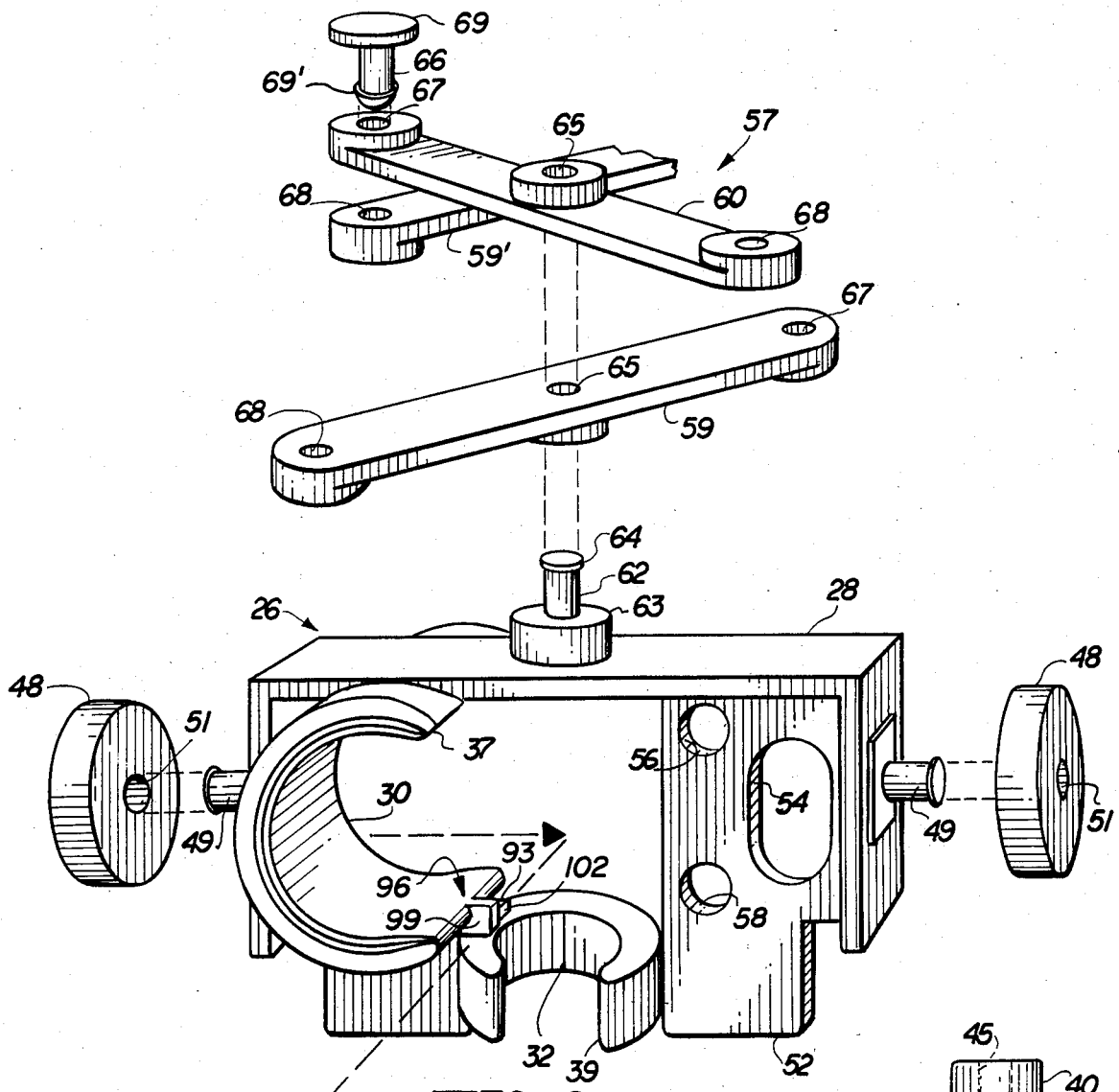
FIG. 8 is an exploded view of the structure of FIG. 5.

Further with regard to FIGS. 5 and 8, the carrier means 26 has runners or followers 48 secured to stub axles 49 projecting outwardly from opposite longitudinal ends thereof. The followers 48 are specifically dimensioned and disposed to fit within a track structure 50 integrally or otherwise fixedly secured to the interior of the head casing 12 to support the individual carrier frames 28 as they travel in opposite directions along the length of the head casing 12. Interconnection between the stub axles 49 and the followers 48 is accomplished by such members 49 passing through integrally formed and centrally located apertures 51. The fit therebetween may allow rotational movement of the followers 48 about the members 49 such that the followers 48 rotate as they travel along the length of the head casing 12 and track 50. Alternately, a frictional engagement may occur such that the followers 48 merely slide within and along the length of the track structure 50.

Figure 7:
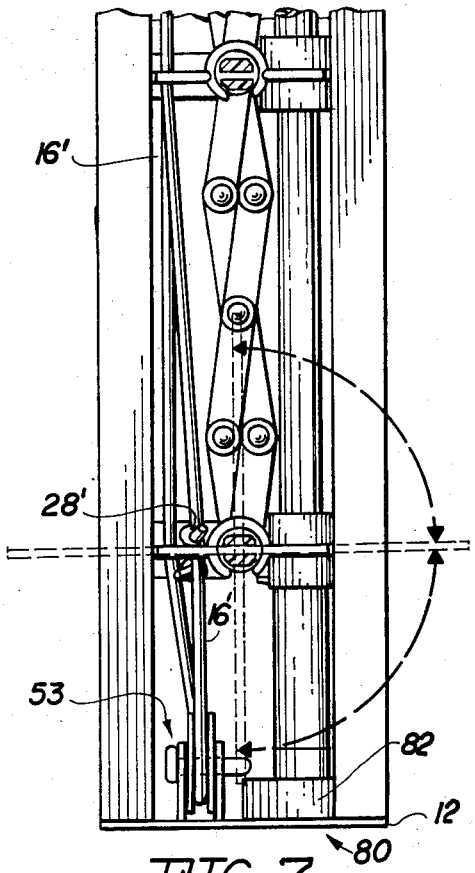
FIG. 7 is a bottom view in partial cutaway showing structural features of the embodiment of FIG. 6 wherein the connecting facility is shown in extended orientation.

Other structural features of each carrier frame 28 includes a facing plate 52 integrally formed on the frame 28 and oriented in substantially transverse relation to the direction of travel of the frame 28 along the length of the head casing 12 and track structure 50. The facing plate 52 includes an apertured construction including elongated aperture 54 and a first and second connecting aperture 56 and 58 respectively. Each facing plate 52 is specifically disposed and configured to cooperate with the first positioning means defining at least in part the pull cord 16. More specifically, the elongated aperture 54 is specifically dimensioned to allow passage therethrough of cord sections 16' (see FIG. 7) upon a pulling or otherwise activation of the pull cord 16 extending exteriorly of and in depending relation to the head casing 12 as described with reference to FIG. 1. With reference to FIG. 7, the endmost carrier frame 28' has the opposite ends of cord section 16' fixedly secured to the first and second connecting apertures 56 and 58 in an opposite orientation. One cord section 16' loops about a pulley assembly generally indicated as 53 and passes through the first connecting aperture 56 and is knotted. The opposite end of the cord section 16' passes directly through the second connecting aperture 58 and is knotted without passing about or in connection with the pulley assembly 53 and is thereby reversely oriented. The endmost carrier frame 28' is thereby selectively positioned either towards or away from the end 80 of the head casing 12 which is directly associated with and serves to support the pulley assembly 53. With reference to FIGS. 5, 8, 6 and 7, each of the connecting frames 28 are successively positioned in spaced apart relation to one another and further are directly interconnected through the provision of a connecting means generally indicated as 57. This connecting means includes a plurality of connecting links each pivotally attached to one another. In addition, the individual links comprise a first link 59 and a second link 60 associated with each carrier frame 28. Such first and second connecting links are disposed in overlapping relation to one another (see FIGS. 5 and 8) and both are pivotally attached to an upstanding pin 62 substantially at the midpoint of the links 59 and 60 so as to rest on an annular platform 63. An enlarged head or flange 64 prevents inadvertent detachment of the individual links 59 and 60 from the pin 62. Each of the connecting links 59 and 60 are somewhat similarly attached to the second and first connecting links respectively associated with the next adjacent carrier frames 28. Each respective first and second connecting links 59 and 60 are pivotally secured to the next adjacent links by pivot pins 66 extending through aligned apertures 67 and 68 formed in opposite ends of each link as clearly shown in FIG. 8. Enlarged and specifically configured ends 69 and 69' prevent inadvertent detachment of the pivot pins 66 from their connecting association with correspondingly positioned ends of the respective links 59 and 60. As also seen in FIG. 8, the upwardly extending pin 62 passes through substantially centrally located and aligned apertures 65 formed in the approximate midportion of each of the connecting links 59 and 60. As clearly shown in FIGS. 6 and 7, the connecting means 57 thereby defines somewhat of an accordionlike structure capable of being extended (FIG. 7) or substantially retracted (FIG. 6) such that forced travel or movement of the endmost carrier frame 28' due to manipulation of the pull cord 16, of the first positioning means, will in turn cause the successive frames 28 to move towards or away from the endmost carrier frame 28' and therefore be contracted or extended relative to the length of the head casing 12 as explained with reference to FIGS. 2 through 4.

Again with reference to FIGS. 6 and 7, a double pulley assembly 53' is provided to carry both of the cord sections 16' as they extend from their depending exteriorly accessible position (see FIG. 1) along the entire length of the head casing 12 to the endmost carrier frame 28'. As set forth above, only a single pulley assembly 54 need be mounted at the opposite end 80 of the head casing 12 for support of a single chord section 16' due to the reverse orientation of the opposite ends of the cord sections 16' as they engage the endmost carrier frame 28'.

Figure 9:
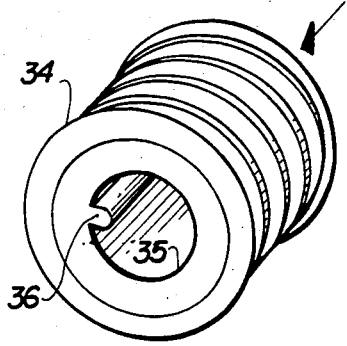
FIG. 9 is a perspective view of the details of a component of the carrier frame.
Figure 14:
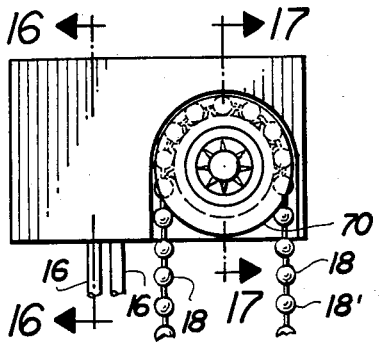
FIG. 14 is an end view of the head casing showing structural details of a positioning assembly associated with the present invention.
Figure 17:
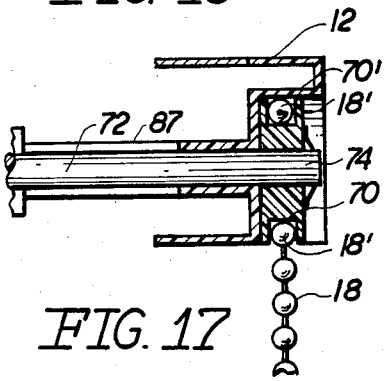
FIG. 17 is a sectional view along line 17—17 of FIG. 14.

The second positioning means of the present invention comprises in part, as set forth above, the beaded pull chain 18 (see FIG. 1). This pull chain 18 is mounted so as to travel in opposite directions about a wheel or pulley (see FIGS. 14 through 17) wherein the periphery of the wheel 70 is defined by a plurality of pockets or compartments specifically dimensioned and disposed to receive the individual bead elements 18' as the pull chain 18 is moved relative to the wheel 70. The wheel 70 is fixedly attached to one end of an elongated positioning rod 72 as at 74 and substantially within a recessed housing 70' (FIG. 17). Accordingly, rotation of the wheel 70, through pulling manipulation of the sprocket chain 18, causes its rotation as well as the rotation of the positioning rod 72 about its own longitudinal axis. With reference to FIGS. 5 and 9, the positioning rod extends substantially the entire length of the head casing 12 and passes concentrically through each of the centrally located channels 35 of the gear elements 34 associated with the plurality of carrier frames 28. An elongated channel or slot 36' extends along the length of the positioning rod 72 and serves to matingly engage the outwardly extending key 36 (FIGS. 5 and 9). Therefore, rotation of the positioning rod 72 upon manipulation of the beaded pull chain 18 causes rotation of each of the gear elements 34 associated with each of the carrier frames 28. As explained in detail above, such rotation of gear element 34 in turn causes rotation of the second spur gear element 40 and selective angular orientation of the vertically depending blinds 14 through their supported interconnection with the holder 20. With reference to FIGS. 14 and 17 fixed attachment of the wheel 70 to the end 74 of the positioning rod 72 accomplishes a one-to-one ratio of rotation and eliminates the necessity of any type of universal gearing assembly which causes a variance in the relative rotational speeds.

Figure 15:
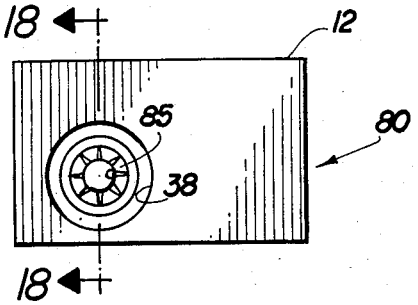
FIG. 15 is an opposite end view of the head casing to that shown in FIG. 14.
Figure 16:
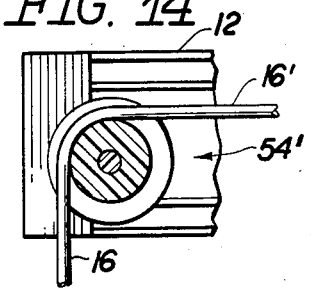
FIG. 16 is a sectional view along line 16—16 of FIG. 14.
Figure 18:
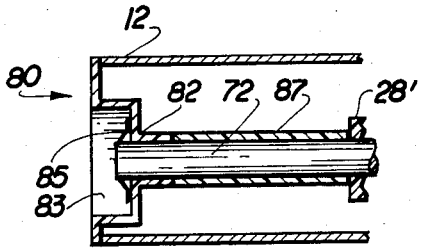
FIG. 18 is a sectional view along line 18—18 of FIG. 15.

With regard to FIGS. 15 and 18, the opposite end of the head casing 12 as at 80 shows the positioning rod 72 merely supported in rotational relation to the recess socket 83 due to a mounting flange 85. Additionally, spacer elements or sleeves 87 may extend between the interior surface of the end 80 of the head casing 12 as at 82 so as to maintain the endmost carrier frame 28' a given spaced distance from the distal end 80. A similar spacing sleeve 87 may be provided at the opposite end of the head casing 12 associated with the sprocket 70 and pull cord 16 and beaded pull chain 18.

Figure 13:
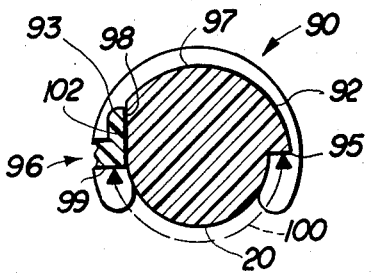
FIG. 13 is a sectional view along line 13—13 of FIG. 5 showing details of a stop structure of the present invention.

With reference to FIGS. 5, 8 and 13, the present blind assembly includes a stop means generally indicated at 90 comprising a first stop portion 92 fixedly secured to rotate with the holder element 20 and a second stop portion generally indicated as 96 disposed adjacent entrance 37 of first recess 30 (FIG. 8) and fixedly secured relatively to a secondary depending flange 93 of the carrier frame 28. The first stop portion includes an outwardly extending flange 95 connected to one end of an eccentrically dimensioned and curvilinearly configured peripheral edge 97 and a first flat 98 integrally formed on the holder 20 at the opposite end of curvillinear edge 97 as shown in cross-section in FIG. 13. The second stop portion 96 includes a step 99 disposed in interruptive relation to the outstanding flange 95 as indicated by the directional arrow 100 and along its rotational path of travel. The second stop portion 96 also includes a second flat 102 is located in interruptive relation and as shown in FIG. 13 in direct mating engagement with the first flat 98 so as to prevent rotation of the holder 20 in the opposite direction. For purposes of clarity, the first and second flat 98 and 102 respectively are shown in mating and stopping engagement with one another when the holder is in the position shown in FIG. 5.

What is claimed is:

1. In a vertical blind assembly of the type including a head casing having an elongated configuration extending in overhanging relation along a given length; a plurality of vertical blinds each attached at its upper end to a holder and movably interconnected in depending relation to said head casing by a carrier means movably mounted to travel along a track formed on said head casing and structured for pivotal orientation of each vertical blind about its own longitudinal axis and collective travel of said plurality of blinds along the length of said head casing between an open, retracted position and a closed, outwardly extended position, the improvement comprising:

(a) each of said carrier means comprising a carrier frame having a one-piece open construction defined by oppositely disposed, open lateral faces on said carrier frame, (b) a follower formed on opposite ends of said carrier frame and being disposed and configured for movable engagement with the track of said head casing and travel of said carrier frame along the length thereof, (c) a first positioning means for moving said plurality of vertical blinds along the length of said head casing between said open position and said closed position and interconnected to consecutively disposed carrier frames and attached to an endmost carrier frame and extending outwardly therefrom in opposite directions, a portion of said first positioning means positioned exteriorly of said head casing for manipulation and activation thereof, (d) a second positioning means extending along the length of said head casing in interconnected substantially driving relation to each of said carrier frames for angular orientation of each of said blinds about its own longitudinal axis, (e) each of said carrier frames including a first recess and a second recess each having an open ended construction, said first and said second recesses disposed in adjacent and spaced, transverse relation to one another, (f) said carrier means further comprising a first gear element rotatably disposed within said first recess and said holder rotatably disposed within said second recess, said holder including a second gear element connected thereto so as to rotate therewith and disposed in mating engagement with said first gear element through said open ended construction of said first recess, (g) said open ended constructions of said first recess and said second recess cooperatively disposed and configured to respectively receive said first gear element and said holder therethrough and said open ended construction of each first and second recess further structured to define a removable, snap-fit connection with said first gear element and said holder respectively, whereby both said first gear element and said holder are removable from said carrier frame independent of one another, (h) wherein said first gear element is connected in driven attachment with said second positioning means to cause rotation of said first gear element within said first recess and rotation of said holder and blind attached thereto, through mating engagement of said first gear element and second gear element, (i) connecting means for movable attachment of each of said carrier frames to the next adjacent carrier frame and structured for movable, collective interconnection of said carrier frames along the length of said head casing, and (j) said carrier means further comprising a stop means disposed and structured for limited rotation of each of said holders and attached vertical blinds about their own longitudinal axis through an arc of substantially 180°.

2. An assembly as in claim 1 wherein said second gear element is removably connected to both said holder and said respective carrier frame and disposable in transverse and mating engagement with said first gear element substantially through said open ended construction of said first recess.

3. An assembly as in claim 1 wherein each of said carrier means includes an outwardly projecting pin fixedly mounted on an upper peripheral portion of said carrier frame, said connecting means movably attached to said pin of each of said carrier frames, said connecting means structured and disposed to provide relative movement of said plurality of carrier frames and attached respective vertical blinds towards and away from one another upon travel of said vertical blinds between said open and said closed positions.

4. An assembly as in claim 3 wherein said connecting means comprises a plurality of interconnecting links including a first and a second link pivotally attached to said pin of each carrier frame in overlapping relation to one another, each first and second link pivotally secured to a second and a first link respectively of the next adjacent carrier frame at opposite ends thereof.

5. An assembly as in claim 4 wherein said plurality of links are pivotally interconnected to one another at correspondingly positioned ends by a plurality of removably attached pivot pins, said connecting means comprising an accordion structure selectively positionable between an elongated extension position and a retracted collapsed position.

6. An assembly as in claim 1 wherein each carrier means comprises said second gear element frictionally connected to said holder, said second gear element and said holder cooperatively dimensioned to allow relative rotation therebetween upon sufficient force exerted on said second gear element.

7. An assembly as in claim 3 wherein said second gear element is removably connected to both said holder and said respective carrier frames and disposable in transverse and mating engagement with said first gear element substantially through said open ended construction, said holder, said second gear element and said pin disposed in aligned, substantially colinear relation to one another.

8. An assembly as in claim 7 wherein said second positioning means comprises a positioning rod extending substantially the length of said head casing and structured for driving attachment to each of said first gear elements of each of said carrier means, each of said first gear elements including a central channel extending therethrough and each being positioned in surrounding, concentric relation about said positioning rod and connected thereto so as to rotate therewith.

9. An assembly as in claim 7 wherein said second positioning means further comprises a pulley element fixedly secured about one end of said positioning rod so as to rotate therewith, a plurality of pockets formed about a periphery of said pulley and a pull-chain assembly including a plurality of bead elements disposed in spaced relation to one another and dimensioned and disposed to fit within said plurality of pockets successively upon movement of said pull-chain relative to said pulley, said pull-chain, pulley and positioning rod each structured and cooperatively dimensioned to provide a one-to-one ratio of rotation of said pulley relative to said positioning rod.

10. An assembly as in claim 1 wherein said stop means comprises a first stop element fixedly secured to each of said carrier frames and a second stop element mounted on said holder element so as to rotate therewith relative to said respective carrier frames, said first stop element disposed in interruptive position relative to at least two spaced apart stop portions which at least partially define said second stop element, said second stop element structured and configured to allow rotation of said holder relative to said carrier frame along an arc of substantially 180° and between interruptive engagement of said first stop element respectively with said spaced apart stop portions.

11. An assembly as in claim 10 wherein said stop portions comprise a first flat and an outwardly disposed flange integrally secured to said holder and interconnected in spaced relation along a curvilinear peripheral edge of said holder.

12. An assembly as in claim 11 wherein said first stop element comprises a step positioned in interruptive, stopping relation along a rotational path of travel of said second stop element and a second flat disposed substantially adjacent said step and in interruptive relation to said first flat at an opposite end of said rotational path of travel.

13. An assembly as in claim 12 wherein said second flat and said step are disposed in substantially transverse and adjacent relation to one another, said first flat and said flange formed at substantially opposite ends of a curvilinear, eccentrically configured peripheral edge and at a corresponding level as said first stop element.

14. An assembly as in claim 1 wherein each of said carrier frames include a facing plate fixedly secured thereto and structured for interconnection to said first positioning means, said facing plate comprising an apertured construction disposed and configured to selectively define connection of said first positioning means and passage therethrough of said first positioning means dependent upon the position of a given carrier frame along the length of said head casing.

15. An assembly as in claim 14 wherein said apertured construction comprises an elongated aperture integrally formed in said facing plate and dimensioned to allow passage of said first positioing means therethrough and in a direction along the length thereof.

16. An assembly as in claim 15 wherein said apertured construction further comprises a first and a second connecting aperture each integrally formed in said face plate in spaced relation to one another and structured for attachment to said first positioning means at opposite ends thereof, wherein said opposite ends are attached to an endmost carrier frame in a reversed orientation relative to one another.

* * * * *